US009739156B2

(12) United States Patent
Boeck et al.

(10) Patent No.: US 9,739,156 B2
(45) Date of Patent: Aug. 22, 2017

(54) GAS TURBINEN ROTOR BLADE

(71) Applicant: MTU Aero Engines AG, Munich (DE)

(72) Inventors: Alexander Boeck, Kottgeisering (DE); Sven Schmid, Munich (DE)

(73) Assignee: MTU Aero Engines GmbH, Munich (DE)

( * ) Notice: Subject to any disclaimer, the term of this patent is extended or adjusted under 35 U.S.C. 154(b) by 246 days.

(21) Appl. No.: 14/550,263

(22) Filed: Nov. 21, 2014

(65) Prior Publication Data

US 2015/0167477 A1 Jun. 18, 2015

(30) Foreign Application Priority Data

Nov. 27, 2013 (DE) ..... 10 2013 224 199

(51) Int. Cl.
*F01D 5/22* (2006.01)
*F01D 11/08* (2006.01)

(52) U.S. Cl.
CPC ..... *F01D 5/225* (2013.01); *F01D 11/08* (2013.01); *F05D 2230/11* (2013.01); *F05D 2230/21* (2013.01); *F05D 2250/314* (2013.01); *Y10T 29/49336* (2015.01)

(58) Field of Classification Search
CPC ..... F01D 5/225; F01D 11/08; F01D 5/141; F01D 5/20; Y10T 29/49336; F05D 2230/11; F05D 2230/21; F05D 2250/314; F05D 2240/307; F16J 15/3428
USPC ..... 416/192
See application file for complete search history.

(56) References Cited

U.S. PATENT DOCUMENTS 2,749,026 A * 6/1956 Shinn ..... B23P 15/006 29/889.22
3,251,601 A * 5/1966 Harvey ..... F01D 11/08 277/424
3,339,933 A * 9/1967 Foster ..... F16J 15/44 277/415
3,537,713 A * 11/1970 Matthews ..... F16J 15/445 277/415

(Continued)

FOREIGN PATENT DOCUMENTS

DE 10 2004 025 321 12/2005
DE 10 2009 030566 12/2010

(Continued)

*Primary Examiner* — John K Fristoe, Jr.
*Assistant Examiner* — Brian Delrue
(74) *Attorney, Agent, or Firm* — Davidson, Davidson & Kappel, LLC

(57) ABSTRACT

A turbine or compressor stage of a gas turbine, the rotor blade having a radially outer shroud (1) which has a sealing fin array having a first sealing fin (3.1) and a second sealing fin (3.2) which is adjacent to the first sealing fin and connected thereto by a first groove base (10) having a circumferential region (13) of maximum radial height, which is located at a first circumferential position is provided. The sealing fin array has a third sealing fin (3.3) adjacent to the second sealing fin and opposite to the first sealing fin, the third sealing fin being connected to the second sealing fin by a second groove base (20) having a circumferential region (23) of maximum radial height, which is located at a second circumferential position different from the first circumferential position.

15 Claims, 2 Drawing Sheets

(56) References Cited

U.S. PATENT DOCUMENTS 4,460,185 A * 7/1984 Grandey ..... F01D 11/122 277/415
4,512,712 A * 4/1985 Baran, Jr. ..... F01D 25/246 411/337
4,662,820 A * 5/1987 Sasada ..... F04D 29/161 415/173.6
4,836,561 A * 6/1989 Lebeck ..... F16J 15/3428 277/400
5,531,568 A * 7/1996 Broadhead ..... F01D 5/186 415/115
5,609,470 A * 3/1997 Dodd ..... B23P 15/02 415/914
5,707,207 A * 1/1998 Benoist ..... F01D 11/005 277/415
5,833,244 A * 11/1998 Salt ..... F01D 11/001 277/418
5,833,518 A * 11/1998 Young ..... F16J 15/3428 451/53
6,425,736 B1 * 7/2002 McMahon ..... F01D 9/042 415/173.4
6,454,526 B1 * 9/2002 Cunha ..... F01D 5/147 415/115
6,648,332 B1 * 11/2003 Burdgick ..... F01D 11/003 277/303
6,896,483 B2 * 5/2005 Dierksmeier ..... F01D 11/18 403/28
6,916,021 B2 * 7/2005 Beeck ..... F01D 5/225 277/411
7,695,244 B2 * 4/2010 Au ..... F01D 9/04 415/174.4
7,775,766 B2 * 8/2010 Meier ..... F01D 11/122 415/173.4
8,002,286 B1 * 8/2011 El-Aini ..... F01D 11/02 277/412
8,016,565 B2 * 9/2011 Berg ..... F01D 5/3007 416/219 R
8,257,044 B2 * 9/2012 Hayasaka ..... F01D 5/225 416/189
9,011,083 B2 * 4/2015 De Martino ..... F01D 11/001 415/170.1
9,022,390 B2 * 5/2015 Amador ..... F01D 11/02 277/418
9,115,591 B2 * 8/2015 Duelm ..... F01D 11/001
2004/0226682 A1 * 11/2004 Ehrhard ..... F01D 5/18 165/11.1
2004/0247442 A1 * 12/2004 Nishimura ..... F01D 5/14 416/219 R
2005/0079058 A1 4/2005 Paquet et al.
2007/0104570 A1 5/2007 Boegli et al.
2007/0207034 A1 * 9/2007 Nogami ..... F01D 5/147 416/219 R
2009/0097980 A1 * 4/2009 Hayasaka ..... F01D 5/225 416/189
2011/0113627 A1 * 5/2011 Alquier ..... B22C 9/04 29/889.7
2012/0003078 A1 1/2012 Pikul et al.
2012/0107123 A1 5/2012 Schlemmer et al.
2012/0195766 A1 8/2012 Cohin et al.
2012/0308393 A1 * 12/2012 Wang ..... C22F 1/10 416/223 R
2013/0259691 A1 * 10/2013 Liu ..... F01D 5/225 416/179
2013/0259699 A1 10/2013 Collin et al.
2015/0023793 A1 1/2015 Bensalah et al.
2015/0027904 A1 * 1/2015 Platz ..... B23H 3/04 205/686
2015/0192028 A1 * 7/2015 Gieg ..... B23P 15/04 415/173.1

FOREIGN PATENT DOCUMENTS

EP 1830037 9/2007
EP 2 402 559 1/2012
FR 2985759 7/2013
GB 857750 A * 1/1961 ..... F01D 5/084
GB 2434842 A * 8/2007 ..... F01D 5/187
JP 07229403 A * 8/1995
JP H10306702 11/1998
JP EP 1331362 A2 * 7/2003 ..... F01D 5/225
WO WO2014137479 9/2014

* cited by examiner

GAS TURBINEN ROTOR BLADE

This claims the benefit of German Patent Application DE 10 2013 224 199.2, filed Nov. 27, 2013 and hereby incorporated by reference herein.

The present invention relates to a rotor blade for a turbine or compressor stage of a gas turbine, a gas turbine, in particular an aircraft engine gas turbine, having such a rotor blade, and to a method for manufacturing such a rotor blade.

BACKGROUND

A turbine rotor blade having a radially outer shroud is known from EP 2 402 559 A1.

Due particularly to asymmetric overhangs of the shroud relative to the airfoil, centrifugal forces generate stresses in the shroud during operation, which stresses tend to twist the shroud.

Therefore, EP 2 402 559 A1 proposes to provide at least one reinforcing rib in a shroud pocket defined in the circumferential direction by two opposite z-shaped ribs, the at least one reinforcing rib extending substantially in the direction of the maximum or principal axis of inertia of the blade or the radially outer portion thereof.

However, such ribs, which are provided in pockets and inclined relative to the axis of rotation, are difficult to manufacture and may also be unfavorable in terms of fluid dynamics.

SUMMARY OF THE INVENTION

It is an object of an embodiment of the present invention to provide a gas turbine, and, in particular, to alleviate at least one of the above-described disadvantages.

The present invention provides a gas turbine, in particular an aircraft engine gas turbine, has one or more turbine stages and one or more compressor stages, each having one or more circumferentially distributed rotor blades. The rotor blades may be attached to a rotor of the gas turbine, either removably or non-removably, in particular by a material-to-material bond, or formed integrally therewith.

At least one of these rotor blades has a radially outer shroud. In an embodiment, the shroud may be formed integrally with an airfoil of the rotor blade, in particular by primary and/or secondary shaping, or attached thereto by a material-to-material bond, in particular by welding. In an embodiment, the shroud has two edges which are opposite to each other in the circumferential direction. In an embodiment, these edges are z-shaped. In an embodiment, the shrouds of circumferentially adjacent rotor blades contact one another along their edges.

On its radially outer curved surface facing away from the airfoil, the shroud has a sealing fin array including at least three sealing fins, in particular a first sealing fin, a second sealing fin adjacent thereto, and a third sealing fin adjacent to the second sealing fin and opposite to the first sealing fin. In a refinement, the sealing fin array may include one or more further sealing fins, in particular a fourth sealing fin adjacent to the third sealing fin and opposite to the second sealing fin, a fifth sealing fin adjacent to the fourth sealing fin and opposite to the third sealing fin, etc. In one embodiment, the first sealing fin is closest to the leading edge; i.e., an upstream-most sealing fin, while in another embodiment, it is closest to the trailing edge; i.e., a downstream-most sealing fin.

In an embodiment, the sealing fin array faces a sealing surface of the gas turbine casing.

In an embodiment, the sealing fins extend at least substantially in the circumferential direction. In an embodiment, different sealing fins, in particular axially adjacent ones, have different radial heights, in particular to follow a divergent or convergent flow duct in which the rotor blade is located.

Each two axially adjacent sealing fins are connected by a groove base. In an embodiment, one or both sealing fins merge into the groove base in particular via a corner, particularly a rounded one. In addition or alternatively, the groove base may have an at least substantially constant radial height in the axial direction in at least one meridional section, in particular in all meridional sections. In particular, the first and second sealing fins are connected by a groove base which is hereinafter referred to as first groove base for purposes of differentiation. The second and the third sealing fins are connected by a groove base which, accordingly, is hereinafter referred to as second groove base. A groove base between a further sealing fin and a sealing fin adjacent thereto; i.e., in particular a groove base that connects the third sealing fin and a fourth sealing fin adjacent to the third sealing fin and opposite to the second sealing fin, or one that connects such a fourth sealing fin and a fifth sealing fin adjacent to the fourth sealing fin and opposite to the third sealing fin, is accordingly referred to as further groove base.

At least the first and second groove bases and, in one embodiment, also at least one further groove base, in particular all further groove bases, have a region of maximum radial height in the circumferential direction. As used herein, "radial height" is understood to be a distance from an axis of rotation of the gas turbine or from a root of the rotor blade.

If in an embodiment, a groove base has two oppositely oriented flanks in the circumferential direction which merge into each other at an edge, then this edge may be a circumferential region of maximum radial height in accordance with the present invention. If in another embodiment, a groove base has two oppositely oriented flanks in the circumferential direction which merge into a plateau at two edges, then this plateau may be a circumferential region of maximum radial height in accordance with the present invention.

A circumferential region of maximum radial height of a groove base is located at a circumferential position in the circumferential direction. If the circumferential region of maximum radial height is an edge at which two oppositely oriented flanks merge into each other, then the circumferential position of this edge may be the circumferential position of the circumferential region of maximum radial height. If the circumferential region of maximum radial height is a plateau into which two oppositely oriented flanks merge at two edges, then in particular the circumferential position of the edge that is closer to the leading edge, the circumferential position of the edge that is further away from the leading edge, or the center between the two edges may be the circumferential position of the circumferential region of maximum radial height in accordance with the present invention.

For purposes of differentiation, the circumferential position of the circumferential region of maximum radial height of the first groove base is hereinafter referred to as first circumferential position, while the circumferential position of the circumferential region of maximum radial height of the second groove base is accordingly referred to as second circumferential position, and the circumferential position of the circumferential region of maximum radial height of a further groove base is accordingly referred to as further circumferential position.

In accordance with one aspect, the first and second circumferential positions are different. In other words, the circumferential region of maximum radial height of the first groove base is circumferentially offset from the circumferential region of maximum radial height of the second groove base. In an embodiment, one or more further circumferential positions may differ from the first circumferential position and/or second circumferential position; i.e., a circumferential region of maximum radial height of a further groove base may be circumferentially offset from the circumferential region of maximum radial height of the first groove base and/or the second groove base. In an embodiment, the circumferential positions of the circumferential regions of maximum radial height of all groove bases differ from each other; i.e., the circumferential regions of maximum radial height of all groove bases are circumferentially offset from one another.

Thus, a stiffening rib which is inclined relative to the axis of rotation, at least in portions thereof, in particular to counteract twisting of the shroud due to centrifugal forces, can be provided within the sealing fin array, particularly in a way that is advantageous in terms of manufacture and/or fluid dynamics.

This may be illustratively explained with reference to a very simple embodiment: if the first and second groove bases are each configured in the manner of a roof ridge, with the ridges being circumferentially offset from one another, then a stiffening rib is created on both groove bases, the stiffening rib diagonally intersecting the second fin disposed therebetween. This stiffening rib may be easily produced by grinding each of the two groove bases in opposite directions and in circumferentially offset relationship to each other.

In an embodiment, a circumferential position of a circumferential region of maximum radial height of a groove base that is further away from the leading edge is circumferentially offset from a circumferential position of a circumferential region of maximum radial height of a groove base that is closer to the leading edge, the offset being in a direction from a trailing edge toward a leading edge of the rotor blade. Accordingly, in an embodiment, the circumferential region of maximum radial height of the second, more downstream groove base may in particular be offset from the circumferential region of maximum radial height of the first, more upstream groove base in a circumferential direction toward a leading edge of the rotor blade. Thus, in an embodiment, the corners of the shroud that are supported to a lesser extent by the airfoil may advantageously be supported to a greater extent by the diagonal stiffening rib in the fin array.

To this end, in particular, the circumferential regions of maximum radial height of three or more, in particular all adjacent groove bases may, additionally or alternatively, lie at least substantially on a straight line. In other words, the circumferential regions of maximum radial height may be circumferentially offset from one another in such a way that they form a diagonal rib intersecting the circumferential fins of the fin array.

In an embodiment, one or more, in particular all groove bases of the sealing fin array each have a first flank and a second flank oriented oppositely thereto. The first flank slopes upwardly to the circumferential region of maximum radial height in the circumferential direction, while the second flank slopes downwardly from the circumferential region of maximum radial height in the circumferential direction. In an embodiment, the first and second flanks may merge into each other at an edge, in particular a rounded one, or into a plateau of at least substantially constant radial height at two edges, in particular rounded ones, as explained earlier herein.

The first flank may in particular slope upwardly from a first edge of the shroud. In addition or alternatively, the second flank may slope downwardly to a second edge of the shroud located opposite to the first edge in the circumferential direction. In an embodiment, it is thereby possible to improve the machining process, in particular the entry and exit of a tool into and from the groove.

In an embodiment, in addition or alternatively, the radial height of the first and/or second flank may vary monotonically, in particular strictly monotonically, in the circumferential direction. In other words, the first flank may slope monotonically upwardly, in particular strictly monotonically upwardly, in particular from the first edge, to the circumferential region of maximum radial height and/or the second flank may slope monotonically downwardly, in particular strictly monotonically downwardly, from the circumferential region of maximum radial height, in particular to the second edge. The first and/or second flank may in particular be linear or straight in the circumferential direction. In an embodiment, it is thereby possible to improve the machining process, in particular a tool path.

As explained earlier herein, groove bases having circumferential regions of maximum radial height which are circumferentially offset from one another are in particular suited for manufacture by machining, in particular by machining with a geometrically undefined cutting edge, preferably by grinding, honing, lapping and/or blasting. In one embodiment, a groove base may additionally or alternatively also be contoured by machining with a geometrically defined cutting edge, preferably by filing, milling and/or cutting, by in particular thermal and/or electrochemical machining, particularly electrical discharge machining, and/or by primary shaping, particularly casting.

BRIEF DESCRIPTION OF THE DRAWINGS

Further advantageous refinements of the present invention will be apparent from the dependent claims and the following description of preferred embodiments. To this end, the drawings show, partly in schematic form, in:

DETAILED DESCRIPTION

Figure 1A:
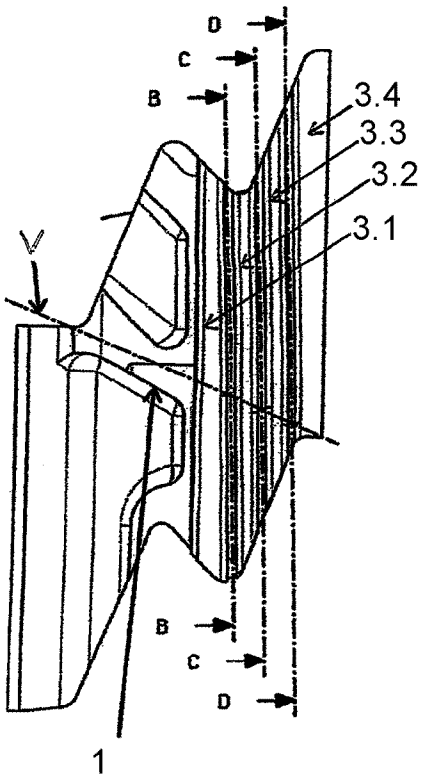
FIG. 1A: a top view looking radially at a shroud of a rotor blade of a gas turbine, according to an embodiment of the present invention.
Figure 1B:
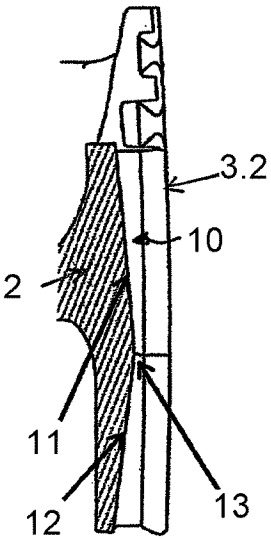
FIGS. 1B-1D: cross-sectional views taken along lines B-B (FIG. 1B), C-C (FIG. 1C) and D-D (FIG. 1D) in FIG. 1A.
Figure 1C:
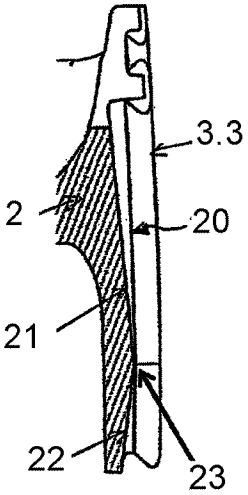
Figure 1D:
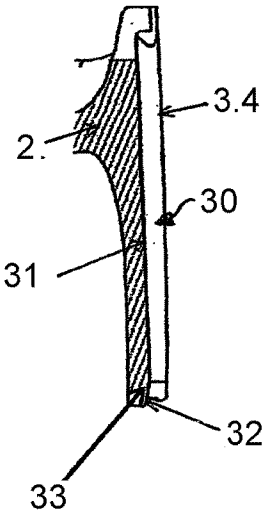

FIG. 1A shows a top view looking radially inwardly at a shroud 1 of a rotor blade of a turbine stage of an aircraft engine gas turbine, according to an embodiment of the present invention. FIGS. 1B through 1D show cross-sectional views taken along lines B-B (FIG. 1B), C-C (FIG. 1C) and D-D (FIG. 1D) in FIG. 1A.

The radially outer shroud is formed integrally with an airfoil 2 of the rotor blade, a portion of which is shown in FIGS. 1B through 1D. The shroud has two z-shaped edges (at the top and bottom in FIG. 1) which are opposite to each other in the circumferential direction.

On its radially outer curved surface facing away from the airfoil (at the right in FIGS. 1B through 1D), the shroud has a sealing fin array including a first sealing fin 3.1 located at an upstream-most position; i.e., closest to the leading edge (at the left in FIG. 1A), a second sealing fin 3.2 adjacent thereto, and a third sealing fin 3.3 adjacent to the second sealing fin and opposite to the first sealing fin, and a further sealing fin 3.4 which is adjacent to the third sealing fin and opposite to the second sealing fin and located at a downstream-most position; i.e., closest to the trailing edge (at the right in FIG. 1A). The sealing fins extend in the circumferential direction (vertically in FIG. 1).

The first and second sealing fins are connected by a first groove base 10; the second and third sealing fins are connected by a second groove base 20; the third and the further sealing fins are connected by a further groove base 30.

The groove bases each have a first flank 11, 21, or 31, respectively, and, oriented oppositely thereto, a second flank 12, 22 or 32, respectively. The first flank slopes linearly upwardly in the circumferential direction (from top to bottom in FIGS. 1B through 1D) from a first edge of the shroud (at the top in FIG. 1) to an edge 13, 23, or 33, respectively, at which it merges into the second flank, which slopes linearly downwardly in an opposite direction toward a second edge of the shroud located opposite to the first edge in the circumferential direction (at the bottom in FIG. 1). Thus, these edges 13, 23, 33 each constitute a circumferential region of maximum radial height of the respective groove base 10, 20 or 30.

These edges, or regions of maximum radial height, 13, 23 and 33 of the first, second and further groove bases are circumferentially offset from one another, as is apparent, in particular, when viewing the cross-sectional views 1B, 1C and 1D together.

The second circumferential position of circumferential region 23 of the second groove base is circumferentially offset from the first circumferential position of circumferential region 13 of the first groove base, which is closest to the leading edge, the offset being in a direction from a trailing edge toward a leading edge of the rotor blade (from top to bottom in FIG. 1), as is apparent, in particular, when viewing the cross-sectional views 1B and 1C together.

The further circumferential position of further circumferential region 33 of groove base 30, which is furthest away from the leading edge, is circumferentially offset in the same manner from the second circumferential position of circumferential region 23 of the second groove base, as is apparent, in particular, when viewing the cross-sectional views 1C and 1D together. Thus, the circumferential regions of maximum height 13, 23 and 33 of the three adjacent groove bases 10, 20 and 30 lie on a straight line.

As a result, a stiffening rib V is created on groove bases 10, 20 and 30, the stiffening rib diagonally intersecting the fins 3.2, 3.3 disposed therebetween. This stiffening rib may be easily produced by grinding each of the groove bases in opposite directions and in circumferentially offset relationship to each other.

Figure 2D:
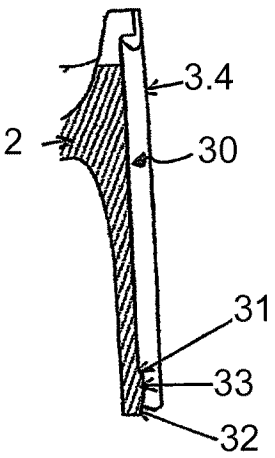
FIGS. 2B-2D: cross-sectional views taken along lines B-B (FIG. 2B), C-C (FIG. 2C) and D-D (FIG. 2D) in FIG. 1A for an alternative embodiment of the present invention.
Figure 2C:
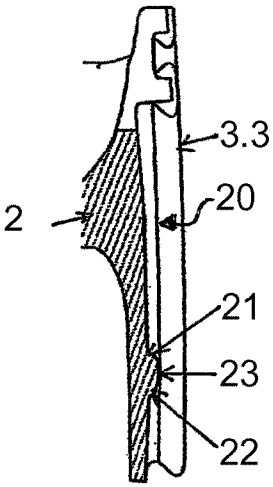
Figure 2B:
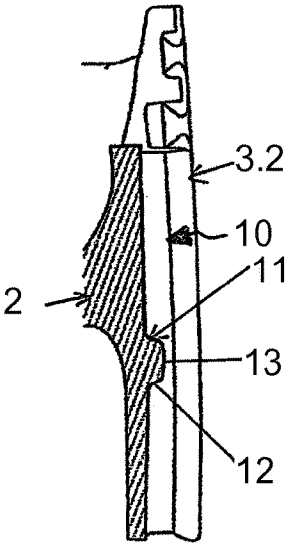

FIGS. 2B through 2D are cross-sectional views corresponding to FIGS. 1B through 1D, illustrating a rotor blade according to an alternative embodiment of the present invention, which, in a top view looking radially inwardly thereat, corresponds to FIG. 1A. Corresponding elements are identified by the same reference numerals, so that reference is made to the above description and only the differences will be discussed below.

In the embodiment of FIG. 2, the first and second flanks 11, 12; 21, 22 and 31, 32, respectively, merge, at a two edges, into respective plateaus 13, 23 and 33 of constant, maximum radial height, each of which consequently constitutes the circumferential region of maximum radial height in accordance with the present invention. The circumferential position of each such plateau may be the circumferential position of the edge that is closer to the leading edge (the lower one in FIG. 2), the circumferential position of the edge that is further away from the leading edge (the upper one in FIG. 2), or the center between the two edges.

Again, the second circumferential position of circumferential region 23 of the second groove base is circumferentially offset from the first circumferential position of circumferential region 13 of the first groove base, which is closest to the leading edge, the offset being in a direction from a trailing edge toward a leading edge of the rotor blade (from top to bottom in FIG. 2), as is apparent, in particular, when viewing the cross-sectional views 2B and 2C together. The further circumferential position of further circumferential region 33 of groove base 30, which is furthest away from the leading edge, is circumferentially offset in the same manner from the second circumferential position of circumferential region 23 of the second groove base, as is apparent, in particular, when viewing the cross-sectional views 2C and 2D together. Thus, again, the circumferential regions of maximum height 13, 23 and 33 of the three adjacent groove bases 10, 20 and 30 lie on a straight line.

Again, as a result, a stiffening rib is created on groove bases 10, 20 and 30, the stiffening rib diagonally intersecting the fins 3.2, 3.3 disposed therebetween. This stiffening rib may be produced, for example, by electrical discharge machining, electrochemical machining or by casting. However, while the diagonal stiffening rib of the embodiment of FIG. 1 is configured in the manner of a roof ridge, the stiffening rib of the embodiment of FIG. 2 has a plateau.

Although the above is a description of exemplary embodiments, it should be noted that many modifications are possible. It should also be appreciated that the exemplary embodiments are only examples, and are not intended to limit the scope, applicability, or configuration in any way. Rather, the foregoing detailed description provides those skilled in the art with a convenient road map for implementing at least one exemplary embodiment, it being understood that various changes may be made in the function and arrangement of elements described without departing from the scope of protection set forth in the appended claims and their equivalent combinations of features.

LIST OF REFERENCE NUMERALS

1 shroud
2 airfoil
3.1 first fin
3.2 second fin
3.3 third fin
3.4 further fin
10 first groove base
20 second groove base
30 further groove base
11; 21; 31 first flank
12; 22; 32 second flank

13; 23; 33 edge/plateau (circumferential region of maximum radial height)

V stiffening rib

What is claimed is:

1. A rotor blade for a turbine or compressor stage of a gas turbine, the rotor blade comprising:

a radially outer shroud having a sealing fin array having a first sealing fin and a second sealing fin adjacent to the first sealing fin and connected to the first sealing fin by a first groove base having a circumferential region of maximum radial height and located at a first circumferential position, the sealing fin array having a third sealing fin adjacent to the second sealing fin and opposite to the first sealing fin, the third sealing fin being connected to the second sealing fin by a second groove base having a further circumferential region of maximum radial height located at a second circumferential position different from the first circumferential position.

2. The rotor blade as recited in claim 1 wherein the sealing fin array has at least one further sealing fin connected to an adjacent one of the first, second and third sealing fins by a further groove base having a third circumferential region of maximum radial height located at a further circumferential position different from the first or second circumferential positions.

3. The rotor blade as recited in claim 1 wherein a circumferential position the groove base is further away from the leading edge than the second groove base, the offset being in a direction from a trailing edge toward a leading edge of the rotor blade.

4. The rotor blade as recited in claim 1 wherein the circumferential region and the further circumferential region lie on a straight line.

5. The rotor blade as recited in claim 1 wherein the groove base of the sealing fin array has a first flank sloping upwardly in the circumferential direction, to the circumferential region of maximum radial height, and, oriented oppositely to the first flank, a second flank slopes downwardly in the circumferential direction from the circumferential region of maximum radial height.

6. The rotor blade as recited in claim 5 wherein the first flank slopes monotonically upwardly and the second flank monotonically downwardly toward a second edge of the shroud located opposite to a first edge in the circumferential direction.

7. The rotor blade as recited in claim 5 wherein the first and second flanks merge into each other at an edge or into a plateau at two edges.

8. The rotor blade as recited in claim 1 wherein the groove base of the sealing fin array is at least partly contoured by machining with a geometrically undefined cutting edge or by primary shaping.

9. The rotor blade as recited in claim 8 wherein the groove base is contoured by machining with the geometrically undefined cutting edge, the machining including grinding, thermal or electrochemical machining, or electrical discharge machining.

10. The rotor blade as recited in claim 8 wherein the groove base is primary-shaped, the primary shaping including casting.

11. A gas turbine comprising:

at least one turbine or compressor stage having at least one rotor blade as recited in claim 1.

12. An aircraft engine gas turbine comprising:

at least one turbine or compressor stage having at least one rotor blade as recited in claim 1.

13. A method for manufacturing a rotor blade as recited in claim 1, the method comprising:

contouring at least one groove base of the sealing fin array by machining with a geometrically undefined cutting edge or by primary shaping.

14. The method as recited in claim 13 wherein the groove base is contoured by machining with the geometrically undefined cutting edge, the machining including grinding, thermal or electrochemical machining, or electrical discharge machining.

15. The method as recited in claim 13 wherein the groove base is primary-shaped, the primary shaping including casting.

* * * * *